United States Patent [19]

Alissandratos

[11] 4,329,755

[45] May 18, 1982

[54] BRUSH

[76] Inventor: Tacko D. Alissandratos, Box 606, Tarpon Springs, Fla. 33589

[21] Appl. No.: 179,401

[22] Filed: Aug. 19, 1980

[51] Int. Cl.[3] ..... B25G 1/04

[52] U.S. Cl. ..... 15/144 B; 15/160; 403/104; 403/350

[58] Field of Search ..... 15/144 R, 144 B, 160, 15/143 B, 172; 403/104, 350, DIG. 7; 81/177 R, 177 A, 177 E; D4/10–12, 29, 31, 32

[56] References Cited

U.S. PATENT DOCUMENTS

| | | | |
|---|---|---|---|
| 1,412,235 | 4/1922 | Felix | 403/104 |
| 2,275,330 | 3/1942 | Tveten | 403/104 X |

FOREIGN PATENT DOCUMENTS

| | | | |
|---|---|---|---|
| 603744 | 4/1960 | Italy | 15/144 B |
| 275213 | 5/1951 | Switzerland | 403/350 |
| 686252 | 1/1953 | United Kingdom | 15/144 B |
| 735255 | 8/1955 | United Kingdom | 15/144 B |

*Primary Examiner*—Peter Feldman
*Attorney, Agent, or Firm*—Edwin E. Greigg

[57] ABSTRACT

A brush including a molded head that includes the bristles and a handle holder. The handle is made in two pieces one of which slips into the other for securing the handle in a retracted or an extended position. A collar in combination with the handle secures the handle in its retracted or extended position.

5 Claims, 8 Drawing Figures

FIG. 4
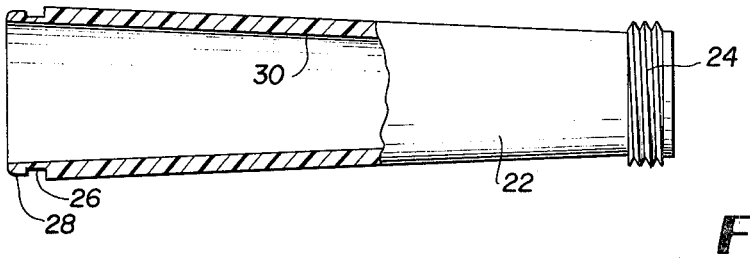
FIG. 5
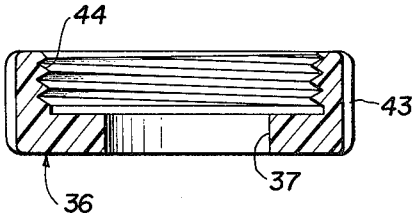
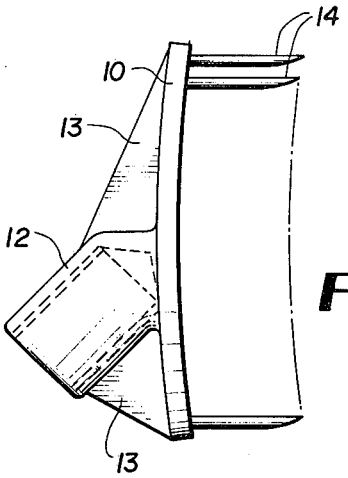
FIG. 7
FIG. 8
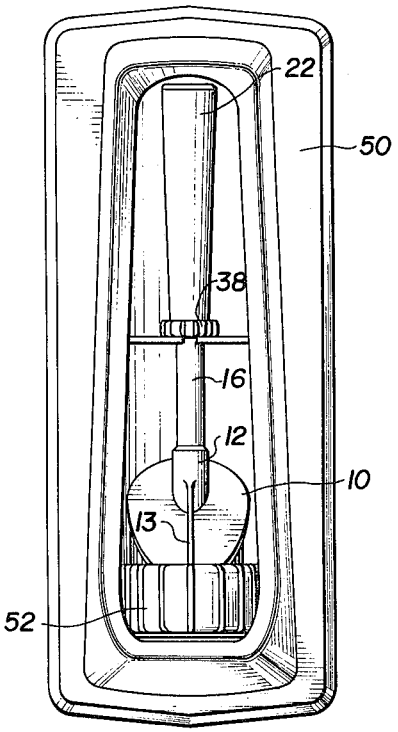
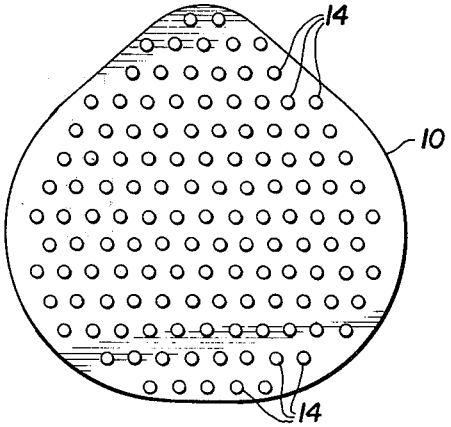
FIG. 6

BRUSH

BACKGROUND OF THE INVENTION

This invention relates to brushes such as used for a sanitary bowl and more particularly to a brush which includes a handle with an extendable shaft.

Heretofore brushes have been made with a one-piece, nonextendable handle. These handles are too short for general use or too long for storage in an acceptable inconspicuous holder, especially in a bathroom where brushes find considerable use.

OBJECT AND SUMMARY OF THE INVENTION

This invention relates to a brush having a handle which is provided with a lock-nut means that locks a mating shaft in either a retracted or an extended position.

The invention will be better understood, and further objects and advantages thereof will become more apparent from the ensuing detailed description of a preferred embodiment taken in conjunction with the drawings.

BRIEF DESCRIPTION OF THE DRAWINGS

FIG. 4 illustrates a partial view of the handle;

FIG. 5 illustrates a collar which secures a handle shaft to a handle;

FIG. 6 illustrates a bottom view of the brush head;

FIG. 7 illustrates a side view of the brush head; and

FIG. 8 illustrates said brush stored within a housing.

DETAILED DESCRIPTION

Figure 1:
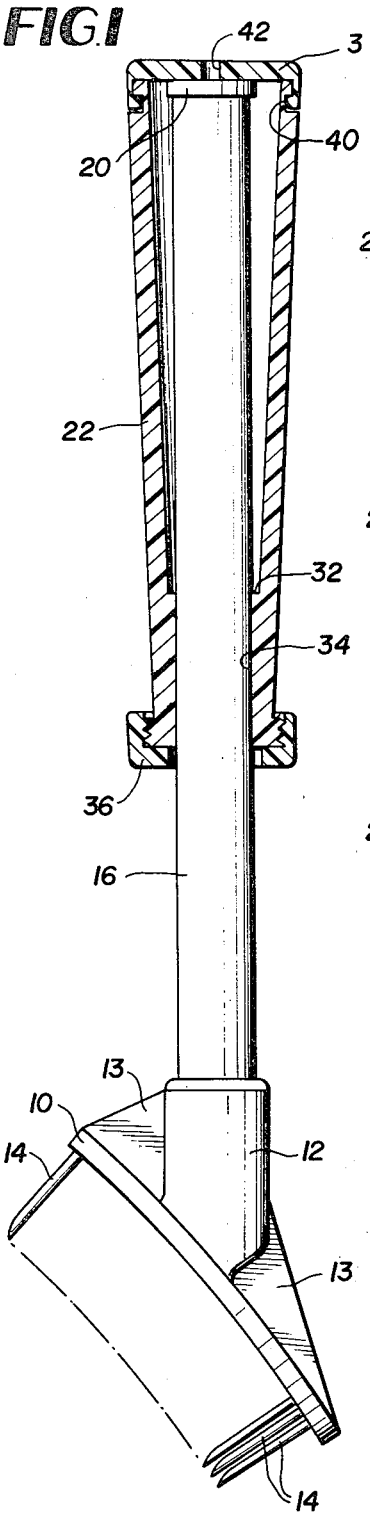
FIG. 1 illustrates a partial cutaway view of the brush of this invention with its shaft in a retracted position.

FIG. 1 illustrates a partial cutaway view of a brush made in accordance with the teaching of this invention. The brush assembly includes a molded brush head 10 which includes a thread handle holder 12 which is fixed at a 45° angle relative to the axis of the head. The molded head is supported by an upstanding rib 13 in front of and behind the handle holder which provides support for the handle holder. The brush bristles 14 are spaced 0.187 inches apart in rows which are 0.187 inches apart with alternate rows of bristles centered on a line centered between the adjacent rows of bristles. In the brush head shown, there are fourteen rows of bristles with a different number of bristles in each row with each bristle having a diameter of 0.093 inches along the major portion of their length of about 0.75 inch with their ends formed at a point. A hollow cylindrical handle shaft 16 having a diameter of approximately one-half inch and a length of about 7.3 inches has threads 18 on one end which thread into the handle holder 12 and a flange 20 on the opposite end. The handle 22 surrounds the handle shaft 16, it has a length of about 4.37 inches and is made with the outer end, the end farthest from the brush head, of larger outer diameter than its inner end, the end closest to the brush head. The inner end of the handle is provided with threads 24 on its outer diameter and a groove 26 near its outer end which forms an end flange 28. The inside diameter 30 of the handle from the outer end toward the inner end decreases in its inner diameter dimension to a diameter of about 0.600 inch to form a shoulder 32 with the inner end of the handle. The last 1.125 inches of the inner diameter 34 is of uniform diameter. The cross-sectional thickness of the handle is uniform from the outer end groove 26 to the shoulder 32 and is thicker from the shoulder 32 to the inner threaded end 24. A nut or collar 36, shown in FIG. 5, has a central aperture 37 with substantially the same diameter as that of the shaft. The central aperture is about 0.040 inches off the axis of the collar to form an eccentric so that the collar binds against the handle shaft as the nut is tightened onto the threaded end of the handle. The inner surface of the collar is provided with threads 44 which threads onto the threaded end of handle 16. A cap 3 fits on the outer end of the handle. The cap 3 is provided with a bead 40 on its inner surface which locks in the groove 26. The cap is provided with an axial aperture 42 which permits air to be forced from inside of the handle as the handle is retracted. Also, any water that may get inside the handle could be drained through the aperture 42. The nut or collar is provided with spaced axially extending ridges 43 on the outer surface to aid in gripping the collar.

The flange 20 on the outer end of the handle shaft has an outer diameter which is substantially the same as the inner diameter of the handle at the shoulder 32 so that the flange will lock in the inside of the handle at the shoulder 32. The inner diameter of the inner end 34 of the handle is substantially the same dimension as that of the main length of the shaft so that the shaft slides through the inner end of the handle. The threads on the nut or collar and the threads on the inner end of the handle are so shaped that the nut tightens on the end of the handle. As the nut tightens the surface of the eccentric hole tightens against the shaft to hold the shaft in place. In this arrangement, the shaft can be locked in the handle when in its retracted or extended position. In the extended position, the shaft flange 20 fits tightly in the inside of the handle at 32 and the nut when tightened squeezes the end of the handle against the shaft.

Figure 2:
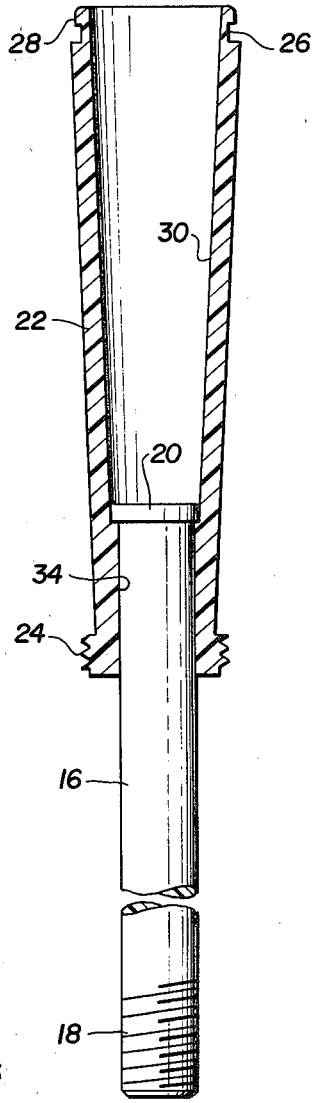
FIG. 2 is a partial view illustrating the handle and shaft in their extended position.
Figure 3:
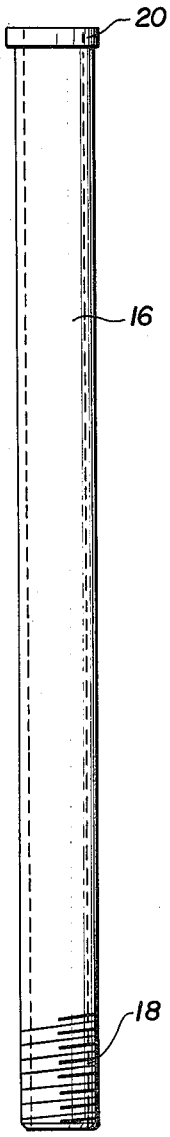
FIG. 3 illustrates the shaft.

In assembly, the brush head is molded and the handle holder is threaded. The threaded end of the shaft is passed through the handle from the large diameter end. The nut or flange is slipped over the threaded end of the shaft that extends through the handle and the shaft is threaded into the handle holder of the brush head. The nut is then threaded partially onto the end of the handle and the end cap is placed on the handle. The shaft is now retained by the handle. The nut can be tightened to secure the handle in its retracted position as shown in FIG. 1 or in the extended position as shown in FIG. 2. In order to extend the handle shaft from its retracted position to its extended position, the collar is loosened until the handle shaft can be pulled from the handle so that the flange is locked in place in the handle. The collar is then tightened to secure the handle shaft in place for use. After use, the collar is loosened, the handle shaft is pushed into the handle so that the flange is adjacent the cap. The collar is tightened to hold the shaft in place. The brush can then be stored.

As shown in FIG. 1, the bristle surface of the brush head is curved from the back to the front so that the bristle ends are not all on the same plane. This affords a better brush surface for cleaning along curved surfaces.

The molded brush head may be made of polyethylene or any other suitable material. Color may be added during the molding process so that the color may be of any desired color.

The brush shaft and handle may be made of polypropylene or any other material and may be made of any desired color. The dimensions given are only exemplary and the parts could be made of any desired sizes within the scope of the invention.

The brush may be hung by the collar in a particular holder made for the purpose or by any other means. FIG. 7 illustrates a holder 50 which may be built into the wall of a bathroom and the brush and holder can be made to match the decor of the bathroom. A cup 52 at the bottom of the housing will catch any water that may remain in the brush without messing the floor. The brush holder can be built on a swivel housing including a backing so that the swivel housing may be rotated to hide the brush within the housing. Therefore the housing will blend in with the wall and the brush will not be seen when in its stored position.

The foregoing relates to a preferred exemplary embodiment of the invention, it being understood that other embodiments and variants thereof are possible within the spirit and scope of the invention, the latter being defined by the appended claims.

What is claimed and desired to be secured by letters patent of the United States is:

1. A brush comprising:

a molded brush head;

said molded brush head including outwardly extending bristles on one surface and a handle holder on the opposite surface fixed at an angle with respect to the axis of said molded brush head;

a handle shaft;

said handle shaft including a threaded end and a flanged end;

a handle;

said handle having an inner end and an outer end, said inner end including a threaded portion on its outer circumference and said outer end having a flange thereon on its outer circumference;

a central aperture with said aperture having a uniform diameter portion and a non-uniform diameter portion, said uniform diameter portion extending from said threaded end toward said flanged end, said non-uniform aperture portion extending from said uniform portion and being of a greater diameter than said uniform portion with said non-uniform portion increasing in diameter from said uniform portion to said flanged end of said handle thereby forming a shoulder at said uniform portion;

said uniform diameter portion being substantially the same diameter as said handle shaft with said flange on said handle shaft having an outer diameter substantially the same as the shoulder at said uniform diameter portion;

a collar;

said collar including threads on its inner surface for engaging said threaded end of said handle and has an aperture of about the diameter of said handle shaft, said aperture has an axis which is off the axis of said collar to provide an eccentric which binds said collar against said shaft as said collar is threaded onto said threaded end of said handle;

whereby said handle shaft may be secured to said handle holder and said shaft may be secured in said handle in a retracted position and an extended position.

2. A brush as set forth in claim 1, wherein:

said brush head is provided with an upstanding rib in front of and behind said handle holder for supporting said handle holder.

3. A brush as set forth in claim 2, in which:

said handle holder is fixed at an angle of 45 degrees with respect to the axis of said molded brush head.

4. A brush holder as claimed in claim 1 which includes:

a cap that fits onto said flanged end of said handle.

5. A brush as claimed in claim 2, 3, 1 or 4 in which:

said bristle surface of said brush head is curved from back-to-front so that the bristle ends are not all on the same plane with the outermost bristles extending outwardly further than the remaining bristles.

* * * * *